US010458120B1

(12) United States Patent
Zhang

(10) Patent No.: US 10,458,120 B1
(45) Date of Patent: Oct. 29, 2019

(54) METAL ROOFING SYSTEM WITH HOOK-ENDED ROOFING SHEETS AND MATING HOLD-DOWNS

(71) Applicant: Xiuming Zhang, Winnipeg (CA)

(72) Inventor: Xiuming Zhang, Winnipeg (CA)

(73) Assignee: Xiuming Zhang, Winnipeg (CA)

( * ) Notice: Subject to any disclaimer, the term of this patent is extended or adjusted under 35 U.S.C. 154(b) by 0 days.

(21) Appl. No.: 16/139,824

(22) Filed: Sep. 24, 2018

(51) Int. Cl.
*E04D 1/34* (2006.01)
*E04D 1/36* (2006.01)
*E04D 1/18* (2006.01)

(52) U.S. Cl.
CPC ..... *E04D 1/34* (2013.01); *E04D 1/18* (2013.01); *E04D 1/36* (2013.01); *E04D 2001/3414* (2013.01); *E04D 2001/3423* (2013.01); *E04D 2001/3455* (2013.01); *E04D 2001/3458* (2013.01)

(58) Field of Classification Search
CPC .... E04D 1/18; E04D 1/34; E04D 1/36; E04D 2001/3467; E04D 2001/3455; E04D 2001/3423; E04D 2001/3458; E04D 2001/3414
See application file for complete search history.

(56) References Cited

U.S. PATENT DOCUMENTS 403,444 A * 5/1889 Patten ..... E04D 1/18 52/530
1,582,727 A * 4/1926 Bradfield ..... E04D 1/34 52/545
1,623,474 A * 4/1927 Hale ..... E04D 1/34 52/545
1,661,067 A * 2/1928 Fulenwider ..... E04D 1/34 52/545
1,741,515 A * 12/1929 Halprin ..... E04D 1/34 52/545
1,850,088 A * 3/1932 Wadsworth ..... E04D 1/125 52/545
2,213,519 A * 9/1940 Faber ..... E04D 1/125 52/394
2,568,603 A * 9/1951 Anthony ..... E04D 1/34 52/544
3,461,628 A * 8/1969 Wienand ..... E04B 1/20 52/309.1
5,685,117 A * 11/1997 Nicholson ..... E04D 1/18 52/520

(Continued)

*Primary Examiner* — Christine T Cajilig
(74) *Attorney, Agent, or Firm* — Kyle R. Satterthwaite; Ryan W Dupuis; Ade & Company Inc.

(57) ABSTRACT

A roofing system features a plurality of roofing sheets each having an outer perimeter of which two opposing perimeter edges respectively define a fastening edge and a hooking edge. One or more fastening holes penetrate the sheet near the fastening edge. At the hooking edge, the sheet is bent under itself to form a hooking portion reaching back toward the fastening edge. A plurality of hold-downs are placed atop a first row of roofing sheets near the fastening edges thereof, and have apertures aligned with the fastening holes of the roofing sheets, through which the hold-downs are fastened to the a roof deck. The hooking edges of a next row of roofing sheets hook to the affixed hold-downs of the first row, thus coupling the two rows of sheets together and concealing the first row's fastened connection to the roof deck beneath the second row.

7 Claims, 3 Drawing Sheets

(56) References Cited

U.S. PATENT DOCUMENTS 6,173,546 B1 * 1/2001 Schafer ..... E04D 1/125
52/519
9,758,970 B2 * 9/2017 Grubka ..... E04D 1/20

* cited by examiner $S_U$
10
18
34
22
24
14
14a
26
32
D
$S_L$
10
18
20

16
$S_L$
10
20
20
28
30
22
24
30
26
18
14
10
$S_U$
16
20
20
20
12
20
20
20
20
18
14
22
30
24
30
26
18
20
10
28
20
14
16
$S_L$
14a

METAL ROOFING SYSTEM WITH HOOK-ENDED ROOFING SHEETS AND MATING HOLD-DOWNS

FIELD OF THE INVENTION

The present invention relates generally to roofing, and more particularly to metal roofing.

BACKGROUND

Applications prior U.S. Pat. No. 9,988,816, the entirety of which is incorporated herein by reference, discloses a metal roofing system in which peg-like fasteners are used to interconnect overlapping rows of metal roofing sheets and fasten same to the underlying roof deck. FIG. 8 of the prior patent shows one such fastener, one end of which features a pair of fastener apertures that are aligned with matching holes near the upstream edge of an underlying lower roofing sheet to enable attachment of the fastener and underlying lower sheet to the roof deck by driving nails through the aligned apertures and openings. An upper roofing sheet is then laid in overlapping relation atop the lower roofing sheet, and features another hole therein near the downstream edge thereof that overlies the lower roofing sheet. An upright threaded post at the second end of the fastener is receivable through this hole of the upper roofing sheet. A nut is then threaded onto the post, thereby fastening the overlapping upper and lower roofing sheets together via the peg-like fastener. Another embodiment shown in FIGS. 11 and 12 of the prior patent instead incorporates the threaded post directly into the roofing sheet itself.

However, the forgoing designs with upright threaded posts are potentially expensive to produce, and result in an array of exposed fastening posts standing upright from the finished roof, creating an unsightly appearance and a potential trip hazard for roof workers.

Accordingly, there remains room for improvement over Applicant's prior design.

SUMMARY OF THE INVENTION

According to a first aspect of the invention, there is provided a roofing system comprising:

a plurality of roofing sheets each having an outer perimeter of which two opposing perimeter edges respectively define a fastening edge, adjacent which at least one fastening hole penetrates through the sheet near said fastening edge, and a hooking edge, at which the sheet is bent under itself to form a hooking portion reaching back toward the fastening edge; and a plurality of hold-downs for coupling together roofing sheets and fastening same onto a roof, each hold-down having a fastening end, an opposing hooking end, a hold-down dimension measured therebetween, and at least one fastening aperture penetrating through the hold-down adjacent the fastening end thereof, said hold-down dimension being lesser than a a sheet dimension measured between the fastening and hooking edges of each roofing sheet.

The hold-downs are placeable atop a first row of the roofing sheets in positions (a) aligning the fastening apertures with the fastening holes of said first row of roofing sheets, (b) occupying a fractional area of the first row of roofing sheets adjacent the fastening edges thereof, and (c) presenting the hooking ends of the hold-downs for hooked engagement thereof by the hooking ends of a second row of roofing sheets to be laid in overlapping relation to the first row of roofing sheets.

In an installed condition of the system on a roof, each hold-down secures together at least one overlapping pair of roofing sheets that comprises a lower sheet and an upper sheet, wherein the upper sheet overlaps the lower sheet, the hooking end of the upper sheet overlies the lower sheet at a location situated across the fastening holes of the lower sheet from the fastening edge thereof, the hold-down overlies the lower sheet adjacent the fastening edge thereof with the fastening aperture of the hold-down aligned over a respective one of the fastener openings in the lower sheet, and the hooking end of the upper sheet hooks around the hooking end of the hold-down and places the hooking portion between the hold-down and the lower sheet.

Preferably a sealant is sandwiched between the hold-down and the lower sheet at a location between the hooking portion of the upper sheet and the respective fastening hole of the lower sheet.

Preferably each hold-down comprises a plurality of fastening apertures arrayed along the fastening end of the hold-down.

Preferably the hold-down dimension measured between the fastening and hooking ends of each hold-down is a width dimension thereof, and said width dimension is less than a length dimension of the hold-down measured along the fastening and hooking ends.

According to a second aspect of the invention, there is provided a roofing sheet having an outer perimeter of which two opposing perimeter edges respectively define a fastening edge, along which at least one set of fastening holes are arrayed and penetrate through the sheet near said fastening edge, and a hooking edge, at which the sheet is bent under itself to form a hooking portion reaching back toward the fastening edge.

According to a third aspect of the invention, there is provided a roofing method comprising:

(a) laying a row of lower roofing sheets atop a sloped roof;

(b) laying one or more hold-downs atop said row of lower roofing sheets at areas thereof adjacent upstream fastening edges of said row of lower roofing sheets, during which fastening apertures in said one or more hold-downs are aligned with corresponding fastening holes in said row of lower roofing sheets;

(c) fastening said one or more hold-downs and the underlying row of lower roofing sheets to the roof through the aligned fastening apertures and fastening holes; and (d) laying a row of upper roofing sheets atop the sloped roof in overlapping upstream relation to the row of lower roofing sheets, during which downstream hooking edges of said row of upper roofing sheets are hooked under the one or more hold-downs that were fastened to the roof through the fastening holes of the lower row of roofing sheets.

Step (b) preferably comprises, running a bead of sealant atop the row of lower roofing sheets at a location thereon situated across the fastening holes from the upstream fastening edges of said lower roofing sheets before or during placement of said one or more hold-downs atop the row of lower roofing sheets, and during said placement, sandwiching said sealant between the row of lower roofing sheets and the one or more hold-downs.

Preferably said sandwiched sealant maintains a gap space between the one or more hold-downs and the underlying row of lower roofing sheets to ease insertion of the hooked downstream ends of the row of upper roofing sheets under said hold-downs.

Preferably each hold-down comprises multiple fastening apertures arrayed along the upstream fastening end thereof, and the fastening apertures of each hold-down and the fastening holes of the row of lower roofing sheets are arrayed at equal spacing to one another.

BRIEF DESCRIPTION OF THE DRAWINGS

One embodiment of the invention will now be described in conjunction with the accompanying drawings in which.

DETAILED DESCRIPTION

Figure 1:
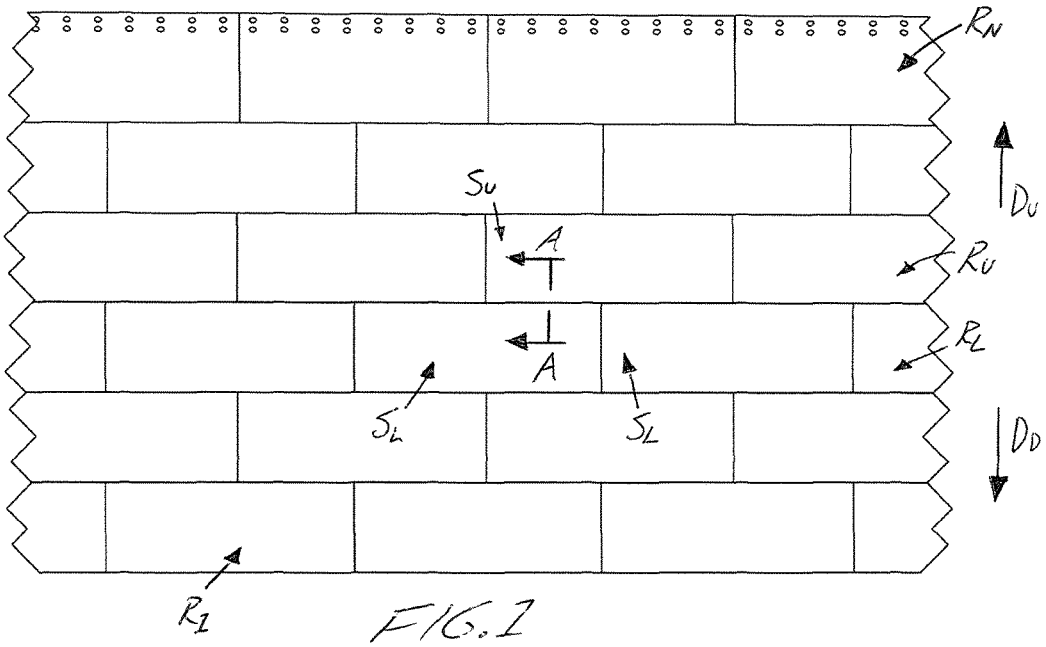
FIG. 1 is an overhead plan view of a section of metal roofing according to the present invention.

FIG. 1 shows a section of installed metal roofing sheets laid atop a roof deck during a roofing operation. The roofing sheets are laid row-by-row from a lowermost row $R_1$ nearest a lower peripheral edge of a sloped roof to an uppermost row $R_N$ at an upper peak of the sloped roof. As used herein, an upstream direction Du refers to an upwardly sloping direction moving toward the roof peak, while a downstream direction $D_D$ refers to a downwardly sloping direction moving the toward the lower peripheral edge of the roof. The downstream thus also refers to the direction in which rainwater gravitationally flows down the covered roof during rainfall.

Figure 4:
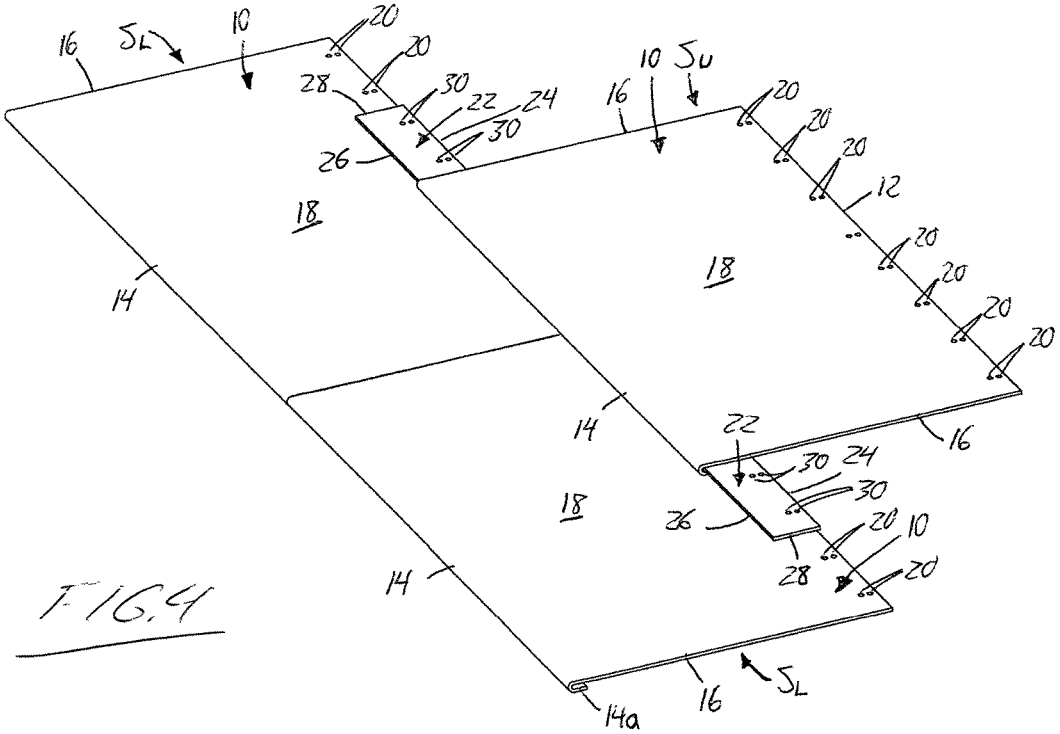
FIG. 4 is an assembled perspective view of the inventive joint of FIG. 3.

Moving in the upstream direction Du toward the roof peak, each row of roofing sheets is overlapped by the next row so that rainwater remains above the sheets as it flows downstream toward the roofs lower peripheral edge. Of any two adjacent rows of sheeting, the one nearest the roof edge is referred to as lower row $R_L$, while the one nearest the roof peak is referred to as the upper row $R_U$. Likewise, of any two overlapping sheets, the one nearest the roof edge is referred to as lower sheet $S_L$, while the one nearest the roof peak is referred to as the upper sheet $S_U$, whereby the upper sheet partially overlies (i.e. overlaps) the lower sheet. As shown in FIGS. 1 and 4, the sheets in the adjacent rows are preferably offset so that the seams between adjacent sheets are offset from one row to the next to minimize potential for leakage between the sheets. Accordingly, each upper sheet $S_U$ in the upper row $R_U$ actually overlaps two lower sheets $S_L$ in the lower row $R_L$.

The roofing sheets, at least in their originally manufactured state prior to any trimming necessary to fit a particular roof installation, are identical to one another. Each roofing sheet 10 is rectangular in plan view, thus having a four-sided outer perimeter featuring a fastening edge 12, an opposing and parallel hooking edge 14, and two side edges 16 that lie opposite and parallel one another in perpendicularly spanning relationship between the fastening edge 12 and hooking edge 14. In the installed position on a roof, the sheet is oriented to place the fastening edge 12 nearest the roof peak, and the hooking edge 14 nearest the lower peripheral roof edge. The fastening edge 12 is thus also referred to as the upstream edge of the installed sheet, while the hooking edge 14 is also referred to as the downstream edge of the installed sheet.

At the downstream hooking edge 14, the sheet 10 is bent through an angle of approximately 180-degrees so as to hook back under itself and thereby form an under-folded hooking portion 14*a* that reaches a short distance back toward the upstream fastening edge 12. Other than this bent hooking end, the remainder 18 of the sheet that spans from the bend to the upstream fastening edge is of flat, planar form. Near the upstream fastening edge 12, the sheet 10 is penetrated by two rows of fastening holes 20. The fastening holes 20 in each row are arrayed at equally spaced intervals along the fastening edge 12, and the two rows align with one another so that the location of each hole along the fastening edge 12 matches the location of a corresponding hole in the other row. The spacing between the two rows is less than the hole-to-hole spacing within each row. The two rows of fastening holes 20 thus create a series of paired holes at equally spaced intervals along the fastening edge. With the exception of these fastening holes adjacent the fastening edge, each sheet may otherwise be a solid unperforated sheet.

Figure 5:
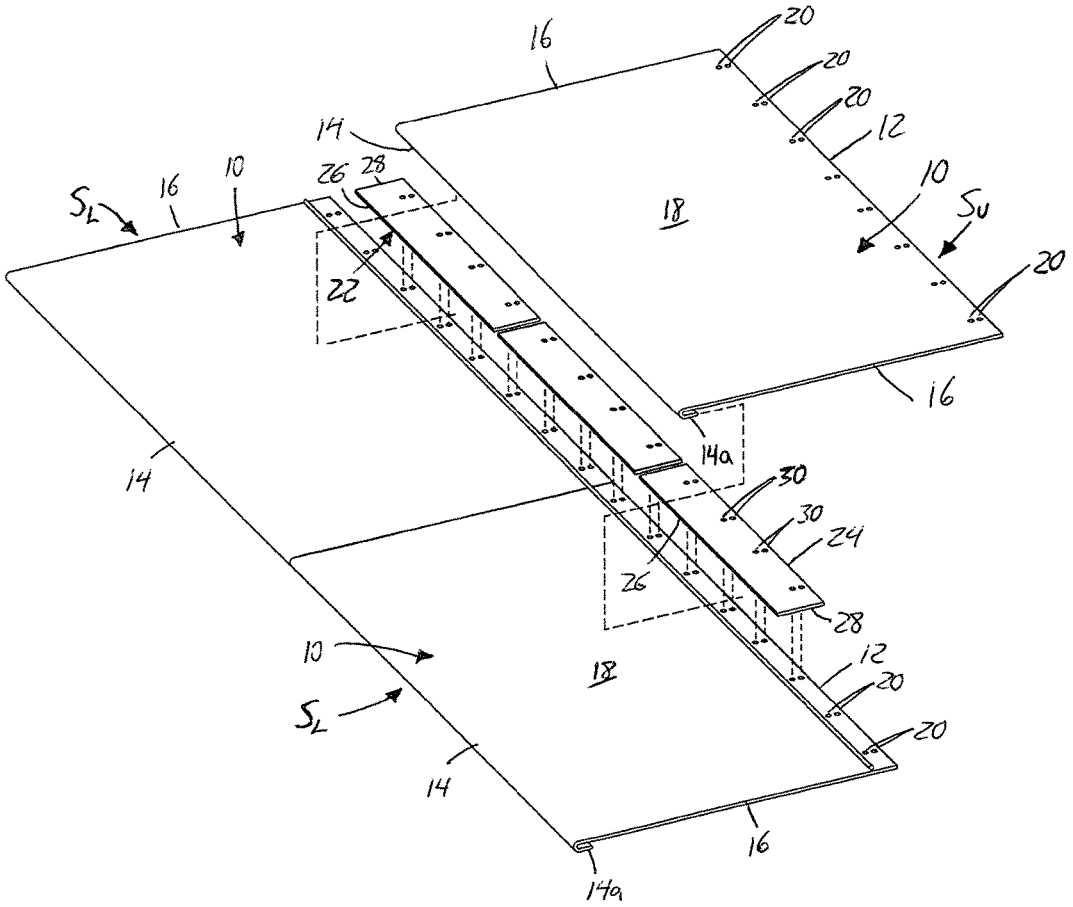
FIG. 5 is an exploded perspective view of the inventive joint of FIG. 3.

With reference to FIG. 5, for the purpose of coupling each upper row of roofing sheets to the underlying lower row, there are provided a plurality of hold-downs 22, though which the lower row is also fastened to the roof deck D. Each hold-down 22 is a flat rectangular plate composed of generally rigid material (e.g. metal or hard plastic). The rectangular hold-down has a fastening end 24, a parallel and opposing hooking end 26, and two parallel and opposing sides 28 that perpendicularly interconnect the fastening end and hooking end. In the installed position assembled with the roofing sheets, each hold-down 22 is oriented to place the fastening end 24 nearest the roof peak, and the hooking end 26 nearest the lower peripheral roof edge. The fastening and hooking ends 24, 26 thus respectively define the upstream and downstream ends of the installed hold-down 22.

Near the outer edge of the hold-down 22 at the upstream fastening end 24 thereof, the hold-down 22 is penetrated by two rows of fastening apertures 30. As shown in the drawings, one of these two rows of fastening apertures is closer to the outer edge of the hold-down than the other row of fastening apertures. The fastening apertures 30 in each row are arrayed at equally spaced intervals along the fastening end 24, and the two rows align with one another so that the location of each aperture along the fastening end 24 matches the location of a corresponding aperture in the other row. The spacing between the two rows is less than the aperture-to-aperture spacing within each row. The two rows of fastening apertures 30 thus create a series of paired apertures at equally spaced intervals along the fastening end of the hold-down 22. With the exception of these fastening apertures adjacent the fastening end, each hold-down may otherwise be a solid unperforated plate or sheet. The interval spacing of the apertures in in the hold-down matches the interval spacing of the fastening holes in the roofing sheets. Likewise, the spacing between the aligned aperture pairs in the hold-down matches the spacing between the aligned hole pairs in the roofing sheets 10.

Figure 3:
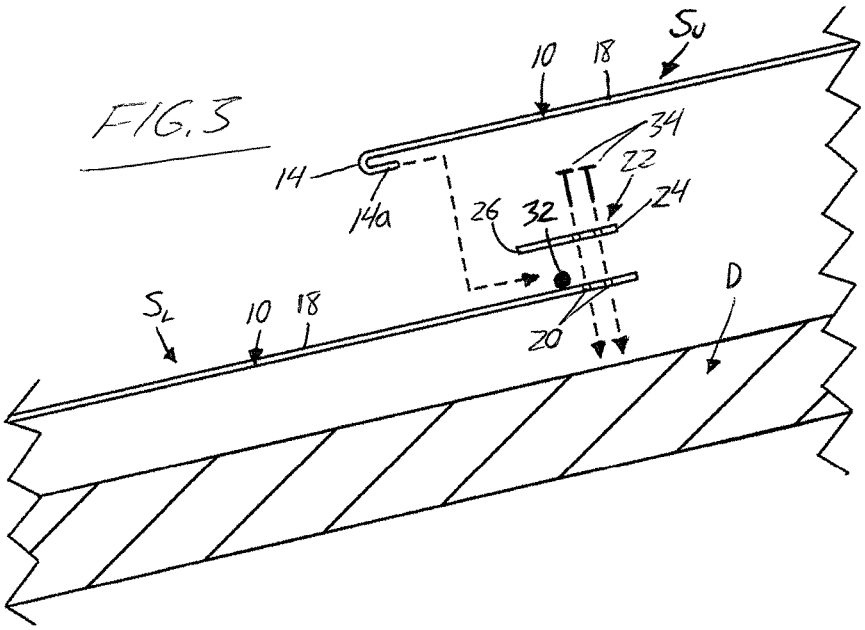
FIG. 3 is an exploded view of the inventive joint of FIG. 2.

A width dimension of each hold-down 22 measured between the fastening and hooking ends thereof is several times lesser than a corresponding width dimension of each roofing sheet 10 measured between the fastening and hooking edges thereof. Accordingly, when the hold-downs are placed atop a lower row of roofing sheets in parallel and adjacent relation to the upstream attachment edges 12 of these lower roofing sheets, the hold-downs 22 occupy only a minor widthwise fraction of the roofing sheet's planar topside, as shown in FIGS. 3 and 5. During this placement of the hold-downs 22, the fastening apertures 30 are aligned over the fastening holes 20 in the lower roofing sheets $S_L$, as enabled by the equal spacing of the hole and aperture layouts in the roofing sheets 10 and hold-downs 22. A length dimension of each hold-down measured perpendicularly to the width thereof, i.e. measured along the fastening and hooking ends of the hold-down, is greater than the width dimension thereof in order to accommodate the notable aperture quantity of the illustrated embodiment.

Referring to the exploded views of FIGS. 3 and 5, installation of the above described roofing system is now described as follows. First, a row of lower roofing sheets $S_L$ are placed atop the roof deck D. Next, a bead of sealant 32 is laid down atop the lower roofing sheets $S_L$ in generally parallel relation to the upstream fastening edge 12 thereof at a sufficient distance inward therefrom so as to reside across the rows of fastening holes 20 from the upstream fastening edge 12. The bead of sealant is laid in close enough proximity to the rows of fastening holes 20 so as to underlie the hold-downs 22 when placed atop the lower roofing sheets $S_L$. Alternatively, a bead of sealant may be laid on the underside of each hold-down 22 at an area thereof situated across the aperture rows from the fastening end of the hold-down, but spaced from the hooking end 26.

The hold-downs 22 are then placed atop the lower roofing sheets $S_L$ in adjacency to the upstream fastening edges 12 thereof and in alignment over the fastening holes 20 therein, thus sandwiching the sealant 32 between the hold-downs 22 and the underlying lower roofing sheets $S_L$. The hold-downs 22 are fastened to the roof deck D by driving nails 34 through the fastening apertures 30 and aligned fastening holes 20, thereby securing both the lower roofing sheets $S_L$ and the hold-downs 22 to the roof deck D.

Next, the hooking edge 14 of an upper sheet $S_U$ is manually lowered down onto an adjacent pair of lower sheets $S_L$ at the majority topside area thereof left unoccupied by the hold-downs 22. The upper sheet is then manually displaced in the upstream direction Du toward the nail-affixed hold-downs 22 until the hooking portion 14*a* of the upper sheet's hooking edge 14 engages under the downstream hooking end 26 of the nail-affixed hold-downs 22. During this insertion of the upper sheet's hooking portion 14*a* under the hold-downs 22, the thickness of the sandwiched sealant 32 may help maintain a small gap space between the hold-downs and the lower sheets in order to make the insertion process easier, thereby reducing or minimizing the need to pry up the downstream hooking end 26 of the hold-down 26 to enable insertion of the hooking portion 14*a* of the upper sheet. The span of the hooking portion 14 of each roofing sheet from the bent edge 14 thereof toward the opposing fastening edge 12 is less than a distance measured from the hooking end 26 of the hold-down 22 to the row of fastening apertures nearest thereto, whereby the inserted hooking portion of the upper sheet doesn't penetrate through the sealant, thus leaving a continuous bead of sealant intact between the lower sheets and the hold-downs 22.

Figure 2:
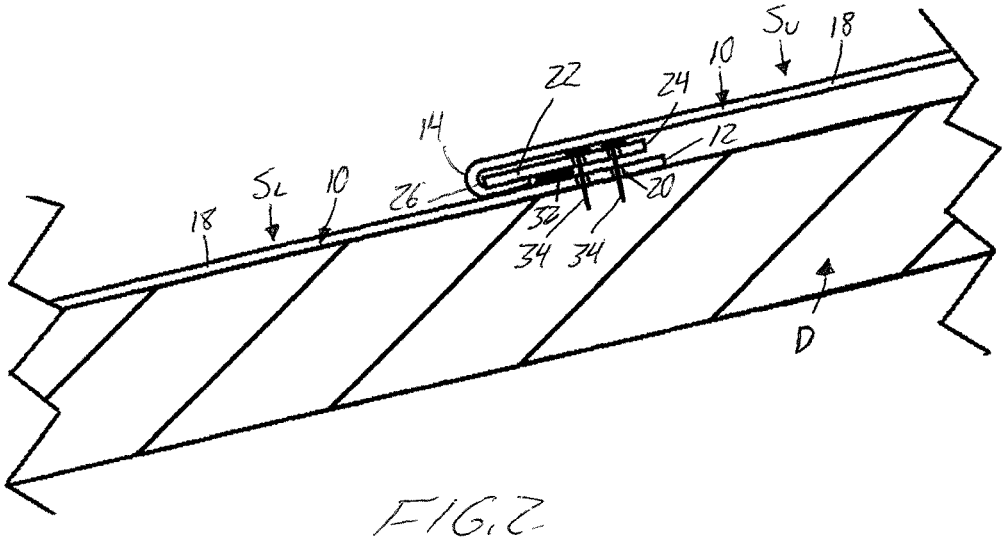
FIG. 2 is a partial cross-sectional view of the metal roofing of FIG. 1 as viewed along line A-A thereof, and illustrating an inventive joint between adjacent rows of roofing sheets.

As shown in FIGS. 2 and 4, this accomplishes a hooked joint between the upper sheet and the previously laid lower sheets via the hold-downs, through which the lower sheets are fastened to the roof deck. Accordingly, when the upper sheet is later fastened to the roof deck through the upper sheet's fastening holes 20, the hooked joint cooperates therewith to prevent movement of the upper sheet relative to the previously laid lower sheets and the underlying roof deck. Meanwhile, the nails 34 used to attain fastened securement of the hold-downs 22 to the roof deck are fully concealed by the planar remainder 18 of the upper sheet.

This process of laying sealant 34 and hold-downs atop the most recently placed row of roofing sheets and then hooking the row of sheets in place is then repeated up to the peak of the roof. As shown in FIG. 1, with the exception of the uppermost row $R_N$, the fastened connection of each row of sheeting to the roof deck is thus concealed by the next row laid in overlapping relation therewith. The uppermost row $R_N$ of sheeting at the peak of the roof may be fastened down to the roof deck through the fastening holes 20 of the rooting sheets with our without placement of hold-downs atop these uppermost roofing sheets, after which a suitable roof peak cap or other covering may be installed over the fastening holes of the uppermost row to conceal same from sight, whether this cap or cover hooks to the optional hold-downs of the uppermost row, or attaches by some other means.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A roofing system comprising:

a plurality of roofing sheets each having an outer perimeter composed of four perimeter edges, including a fastening edge and a hooking edge that lie opposite one another, and two side edges that lie opposite one another and span between to the hooking and fastening edges, wherein the sheet is bent under itself at the hooking edge to form a hooking portion reaching back toward the fastening edge; and a plurality of hold-downs defined separately of the roofing sheets and configured for later securement thereto only during fastening of said hold-downs onto a roof, each hold-down having a fastening end, an opposing hooking end, a hold-down dimension measured therebetween, and a plurality fastening apertures penetrating through the hold-down at locations distributed along an outer edge of the hold-down that denotes the fastening end thereof, said plurality of fastening apertures including some fastening apertures situated nearer to said outer edge of the hold down than others of said fastening apertures, said hold-down dimension being lesser than a sheet dimension measured between the fastening and hooking edges of each roofing sheet;

wherein:

with a sole exception of the hooking edge at which the sheet is bent under itself, each roofing sheet is of entirely flat planar form, thus being flat and planar at both of the two side edges and at the fastening edge; and each hold-down is of entirely flat and planar form.

2. The roof covering system of claim 1 wherein each hold-down secures together at least one overlapping pair of roofing sheets that comprises a lower sheet and an upper sheet, wherein the upper sheet overlaps the lower sheet, the hooking end of the upper sheet overlies the lower sheet at a location spaced from the fastening edge thereof, the hold-down overlies the lower sheet adjacent the fastening edge thereof, the hold-down and the lower sheet are held in place by fasteners engaged through the plurality of fastening apertures, and the hooking end of the upper sheet hooks around the hooking end of the hold-down and places the hooking portion between the hold-down and the lower sheet.

3. The roof covering system of claim 2 comprising a sealant sandwiched between the hold-down and the lower sheet at a location between the hooking portion of the upper sheet and the fasteners.

4. The roof covering system of claim 1 wherein the hold-down dimension measured between the fastening and hooking ends of each hold-down is a width dimension thereof, and said width dimension is less than a length dimension of the hold-down measured along the fastening and hooking ends thereof.

5. A roofing method using the roof covering system of claim 1, said method comprising:

(a) laying a lower row of the roofing sheets atop a sloped roof with the fastening edges thereof in upstream relation to the hooking edges thereof;

(b) laying one or more of the hold-downs atop said lower row of roofing sheets over areas thereof adjacent the fastening edges of said lower row of roofing sheets;

(c) fastening said one or more hold-downs and the underlying lower row of roofing sheets to the roof through the plurality of fastening apertures; and (d) laying an upper row of the roofing sheets atop the sloped roof in overlapping upstream relation to the lower row of roofing sheets, during which the hooking edges of said upper row are hooked under the one or more hold-downs that were fastened to the roof through the fastening apertures.

6. The method of claim 5 wherein step (b) comprises, placing a bead of sealant atop the lower row of roofing sheets at a location thereon spaced inwardly from the fastening edges thereof before or during placement said one or more hold-downs atop the lower row of roofing sheets, and during said placement of the one or more hold-downs, sandwiching said sealant between the lower row of roofing sheets and the one or more hold-downs.

7. The method of claim 6 wherein, after placement of the bead of sealant in step (c) and prior to insertion of the hooking edges of the upper row of roofing sheets under the one or more hold downs in step (d), a gap space is established and maintained between the one or more hold-downs and the underlying lower row of roofing sheets solely by the sandwiched sealant between the lower row of roofing sheets and the one or more hold-downs, whereby said gap space eases subsequent insertion of the hooking edges of the upper row of roofing sheets under said hold-downs in step (d).

* * * * *